US006226806B1

(12) United States Patent
Ball

(10) Patent No.: US 6,226,806 B1
(45) Date of Patent: May 8, 2001

(54) WASTE WATER STRAINER AND VALVE

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 09/630,886

(22) Filed: Aug. 2, 2000

(51) Int. Cl.[7] ..... E03C 1/22
(52) U.S. Cl. ..... 4/295; 4/286; 4/287
(58) Field of Search ..... 4/286, 287, 293, 4/294, 295, 288, 291, 292

(56) References Cited

U.S. PATENT DOCUMENTS

| | | | | |
|---|---|---|---|---|
| 3,314,085 | | 4/1967 | Minella | 4/287 |
| 4,457,030 | | 7/1984 | Burry | 4/286 |
| 5,428,847 | | 7/1995 | Atkins et al. | 4/295 |
| 5,692,248 | * | 12/1997 | Ball | 4/286 |
| 6,066,119 | * | 5/2000 | Ball | 4/286 |
| 6,067,669 | * | 5/2000 | Peterson | 4/288 |

* cited by examiner

*Primary Examiner*—Charles R. Eloshway
(74) *Attorney, Agent, or Firm*—Zarley, McKee, Thomte, Voorhees & Sease

(57) ABSTRACT

A waste water strainer has a horizontal flange having a center opening. A hollow barrel is secured to and extends downwardly from the flange and has a center opening concentrically located with respect to the center opening in the flange. A hollow strainer extension is threadably secured to a lower end of the barrel. A sleeve with an internal concave surface is slidably and removably mounted within the upper end of the strainer extension. A circular disk valve having an annular outer surface symmetrical with the concave surface of the sleeve is pivotally mounted on the concave surface of the sleeve. The sleeve is supported at the lower end of the hollow strainer and extends upwardly to engagement with a lower surface of the flange. The flange and the barrel have a chrome-like finished surface, and the strainer extension has a different finish surface.

1 Claim, 3 Drawing Sheets

WASTE WATER STRAINER AND VALVE

BACKGROUND OF THE INVENTION

A strainer in the plumbing field is the threaded fitting in the bottom of a sink, bathtub, or the like through which waste water flows from the receptacle. Strainers usually have valves or the like which control the gravity flow of water therethrough. All of these valve assemblies are threadably mounted within a threaded aperture located in the strainer.

Typically, existing strainers are of one-piece construction and have a flange which engages the bottom of the tub and a downwardly extending threaded sleeve which threads onto a fitting adjacent a vertically disposed aperture in the bottom of the water receptacle. The entire strainer is often made of chrome or the like which is a relatively expensive material. It is also difficult to machine such a one-piece device to provide threads in places for its attachment to other components in the drain assembly.

It is therefore a principal object of this invention to provide a strainer which is very economical from both a material point of view and from a fabrication point of view.

A further object of the invention is to provide a strainer which can be easily converted from a pivoted disk-type closure to a vertically moveable closure of the type of U.S. Pat. No. 5,758,368.

More specifically, it is a further object of this invention to provide a strainer comprised of two pieces wherein the strainer assembly is comprised of two components, namely, a flange to engage the surface around the discharge aperture in the bathtub, and a strainer extension which is threadably secured thereto, and wherein the flange is comprised of a chrome plated material and the strainer extension is comprised of brass or a more economical material.

A still further object of the invention is to provide a strainer which has a valve therein which is easily installed, operated, and which is durable in use.

These and other objects will be apparent to those skilled in the art.

SUMMARY OF THE INVENTION

A waste water strainer has a horizontal flange having a center opening. A hollow barrel is secured to and extends downwardly from the flange and has a center opening concentrically located with respect to the center opening in the flange. A hollow strainer extension is threadably secured to a lower end of the barrel.

A sleeve with an internal concave surface is removably mounted within the upper end of the strainer extension. A circular disk valve having an annular outer surface symmetrical with the concave surface of the bushing is pivotally mounted on the concave surface of the bushing.

The flange and the barrel have a chrome-like finished surface, and the strainer extension has a different finish surface.

DESCRIPTION OF THE PREFERRED EMBODIMENT

Figure 1:
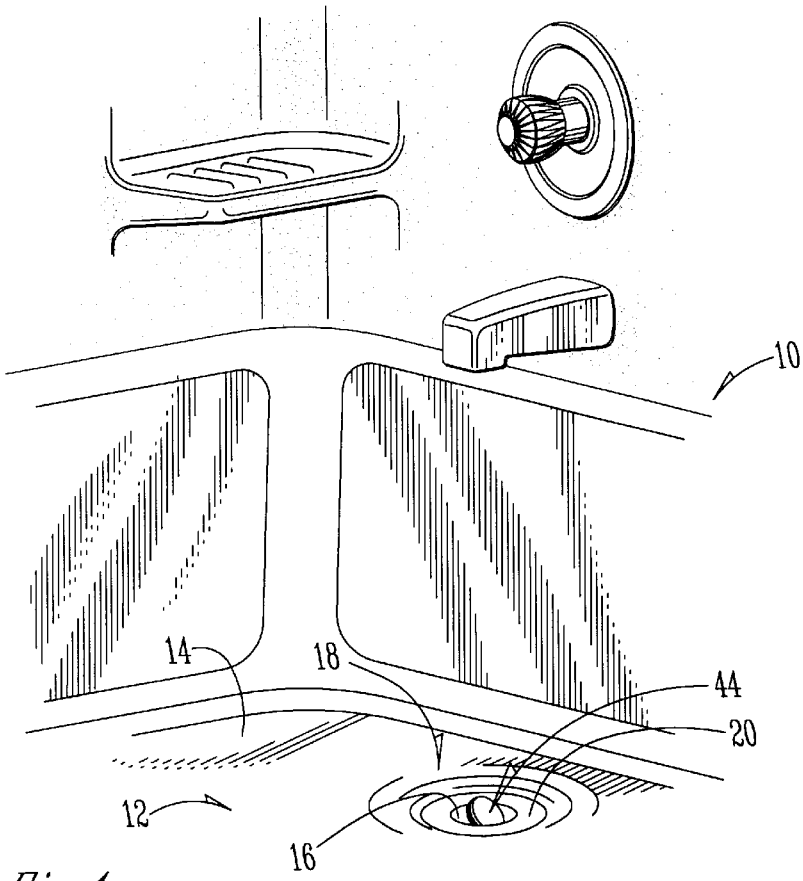
FIG. 1 is a partial perspective view of a conventional bathtub with the inventive waste water strainer located in the bottom thereof.

The numeral 10 designates a conventional fluid compartment or receptacle such as a tub or sink. Compartment 10 has a bottom 12 with an interior bottom surface 14. A waste water aperture 16 is located in bottom 12.

A waste water strainer 18 (FIGS. 1–4) has a peripheral flat flange 20 with a center opening 22. A downwardly extending hollow barrel is integrally formed with flange 22. The diameter of opening 22 in flange 20 is smaller than the diameter of the barrel 24. Barrel 24 has internal threads 26 an outer cylindrical surface 28.

Figure 3:
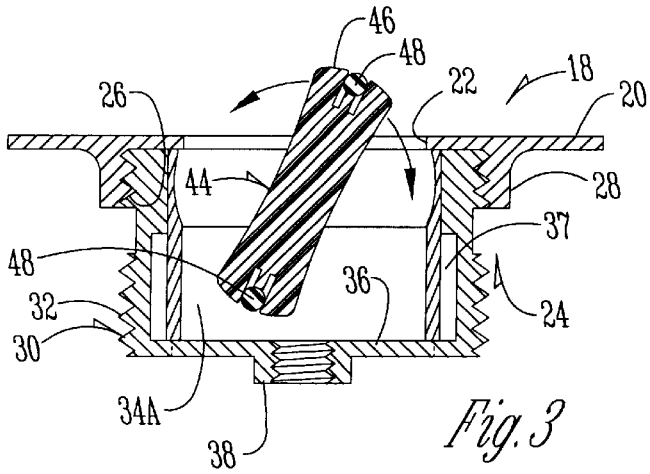
FIG. 3 is a view at a smaller scale similar to that of FIG. 1 but shows the waste water strainer in FIG. 2 with the valve thereof in an open condition.
Figure 4:
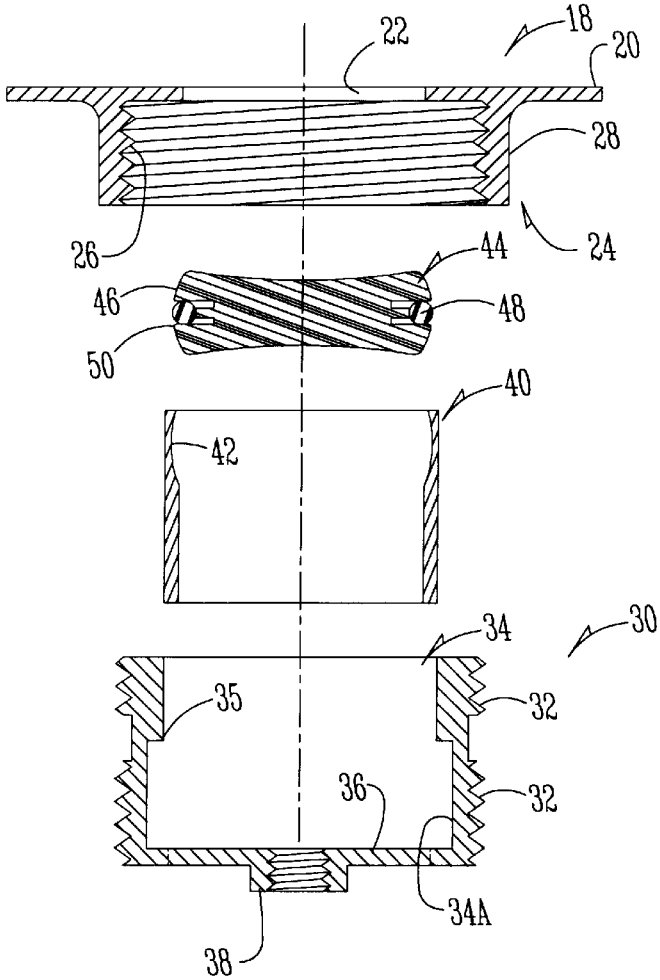
FIG. 4 is an exploded view of the non-assembled components of the device of FIG. 2.

A strainer extension 30 (FIGS. 1–4) has upper external threads 32 which match the internal threads 26 of barrel 24 (FIG. 4). The strainer extension 30 has a center opening 34 at its top which communicates with a center opening 34A in its lower portion of a slightly greater diameter. The openings 34 and 34A are separated by a shoulder 35 which will be discussed hereafter.

Figure 2:
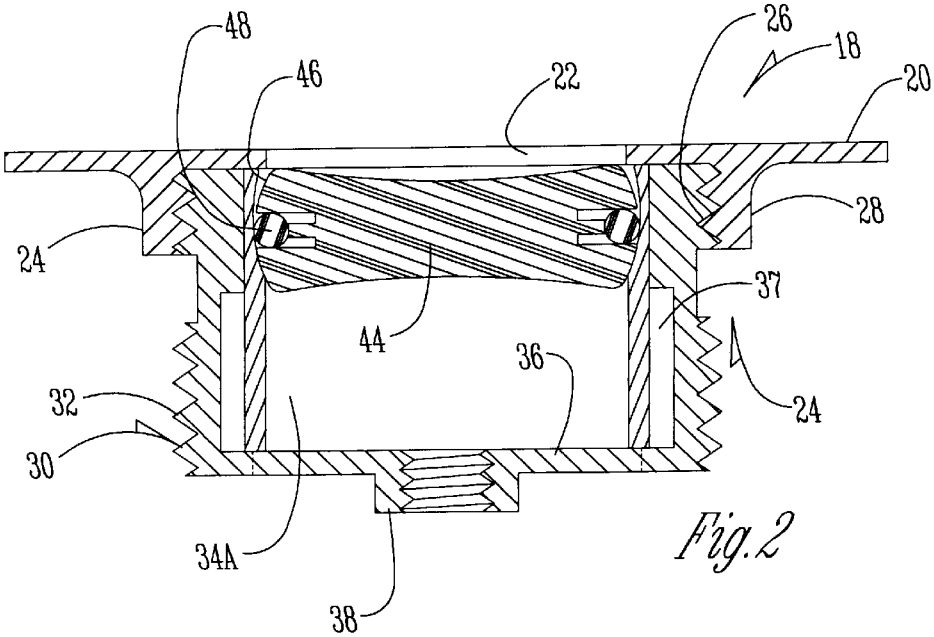
FIG. 2 is an enlarged scale sectional view taken through the waste water strainer when closed.
Figure 2A:
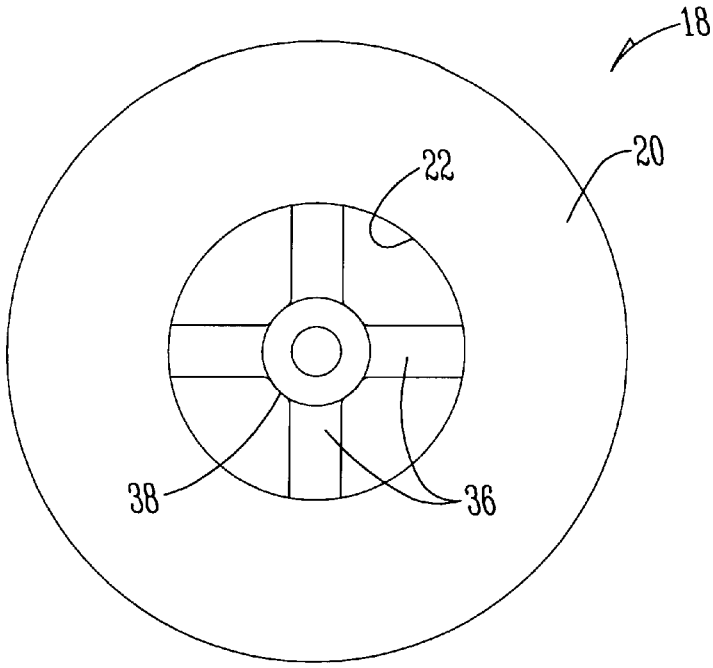
FIG. 2A is a top plan view of FIG. 2 at a smaller scale.
Figure 2B:
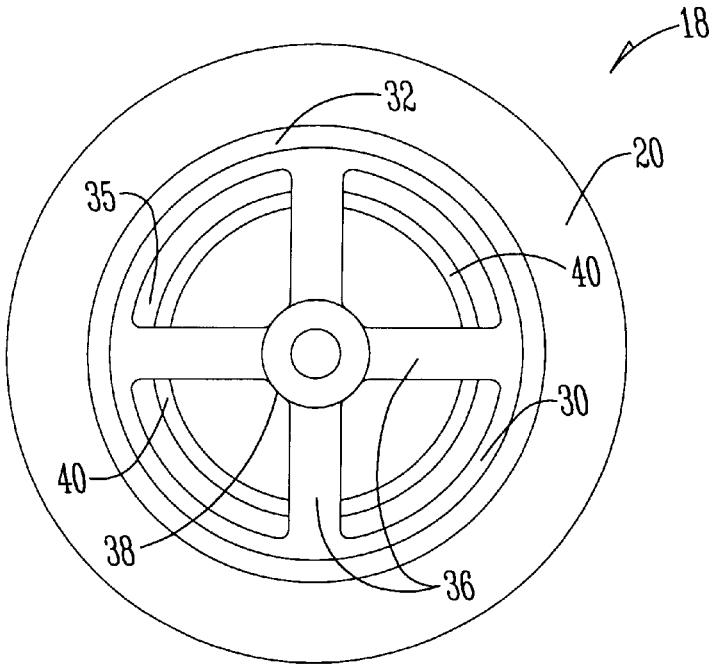
FIG. 2B is a bottom plan view of FIG. 2 at a smaller scale.

Radial-spaced arms 36 and the bushing 38 are present to permit an alternate form of a closure valve to be used such as that disclosed in U.S. Pat. No. 5,758,368. The plurality of spaced arms 36 extend radially outwardly from internally threaded bushing 38 with the outer end of the arms 36 being rigidly connected to the internal bottom diameter of the center opening 34A of the strainer extension 30. (FIGS. 2–4).

A cylindrical sleeve 40 rests in center opening 34 upon arms 36. Sleeve 40 has an internal concave shaped surface 42 which rotatably receives a valve disk 44. Disk 44 has a concave outer periphery surface 46. A resilient O-ring 48 is located within an annular notch 50 in the outer surface 46 of disk 44 to yieldingly but frictionally engage the concave inner surface 42 of the sleeve 40.

Sleeve 40 has an outside diameter substantially equal to the diameter of center opening 34 of strainer extension 30. Sleeve 40 also has a height that spans the vertical distance from arms 36 to the lower surface of flange 20 (FIGS. 2 and 3). When sleeve 40 is assembled in the center opening 34 of strainer extension 30, a space 37 extends around the lower outside surface of sleeve 40 (FIG. 2). In this assembled condition the sleeve 40 is bound in place between the arms 36 and the lower surface of flange 20.

With reference to FIG. 7, the disk 44 and the concave inner surface 42 of sleeve 40 both have substantial equal diameters. The similarities in the foregoing dimensions are to permit the disk 44 to be pivoted from the closed position of FIG. 2 to an open position as shown in FIGS. 1 and 3. The O-ring 48 frictionally maintains the disk in any given position within the concave surface 42 of the sleeve 40. However, manual rotational pressure on the disk 44 will cause it to rotate to any position between being completely open or completely closed.

A very important part of this invention is the fact that the structure of the waste water strainer 18, including the flange 20 and the downwardly extending barrel 24, are chrome plated to provide a stable, durable, and attractive appearance. While having such a finish, the chrome plating or equivalent is an expensive process. However, the strainer extension 30 is comprised of brass or the like which is a much more economical material to finish and fabricate. Thus, the device of this invention is much more economical to both finish and to machine than the typical one-piece waste water assemblies of the prior art. Further, the sleeve provides a very economical way to open and close the waste water assemblies of this invention. Further, the sleeve 40 can be easily removed along with disk 44 to permit the closure of U.S. Pat. No. 5,758,368 to be utilized in conjunction with flange 20 and bushing 38 without having to replace the remaining components.

It is therefore seen that this invention will achieve at least all of its stated objectives.

What is claimed is:

1. A waste water strainer, comprising, a horizontal flange having a center opening, a hollow barrel secured to and extending downwardly from the flange and having a center opening concentrically located with respect to the center opening in the flange, and a hollow strainer extension threadably secured to and extending downwardly from a lower end of the barrel, the strainer extension having a bottom, a top and a center opening with a plurality of radial arms extending across the bottom, a sleeve with an internal concave surface and a top edge slidably and removably mounted within the strainer extension and resting on the radial arms, with the top edge thereof engaging a lower surface of the flange, and a circular disk valve having an annular outer surface symmetrical to the concave surface of the sleeve pivotally mounted with respect to the concave surface of the sleeve.

* * * * *